United States Patent [19]

Kreinbrink et al.

[11] 4,295,038

[45] Oct. 13, 1981

[54] MARKING AND COUNTING PROBE ASSEMBLY

[75] Inventors: Paul H. Kreinbrink, Temperance, Mich.; David C. Neiman, Waterville, Ohio

[73] Assignee: Libbey-Owens-Ford Company, Toledo, Ohio

[21] Appl. No.: 83,407

[22] Filed: Oct. 10, 1979

[51] Int. Cl.[3] ..... G06M 11/00

[52] U.S. Cl. ..... 235/92 PK; 235/92 PC; 235/92 CP

[58] Field of Search ..... 235/92 PK, 92 PC, 92 CP; 340/146.3 SY

[56] References Cited

U.S. PATENT DOCUMENTS

| | | | |
|---|---|---|---|
| 3,064,888 | 11/1962 | Van De Mark | 235/92 PK |
| 3,344,259 | 9/1967 | Degelman | 235/92 PC |
| 3,528,295 | 9/1970 | Johnson et al. | 340/146.3 SY |
| 3,792,240 | 2/1974 | Stumpo | 235/92 PK |
| 3,808,408 | 4/1974 | Given et al. | 235/92 PC |
| 3,862,402 | 1/1975 | Igarashi et al. | 235/92 PK |

FOREIGN PATENT DOCUMENTS

| | | | |
|---|---|---|---|
| 2542831 | 4/1977 | Fed. Rep. of Germany | 235/92 PK |

OTHER PUBLICATIONS

R. B. Lange, "Marking and Counting Device", IBM Tech. Discl. Bulletin, vol. 20, No. 11B, pp. 4892–4893, Apr. 1978.

Alexandrovich, "Convert Your Pocket Calculator into a Programmable Counter", Electronic Design, vol. 23, p. 100, Mar. 1975.

*Primary Examiner*—Joseph M. Thesz

*Attorney, Agent, or Firm*—Collins, Oberlin & Darr

[57] ABSTRACT

An apparatus for serially counting the fragments of a fractured tempered glass article including a probe assembly for touching and producing an electrical signal each time a fragment is touched, the probe assembly also marking each touched fragment. The apparatus also includes a numerical counter electrically connected to the probe assembly for cumulatively adding the number of fragments touched in a given area of the article and displaying a running tally of the counted fragments.

11 Claims, 5 Drawing Figures

MARKING AND COUNTING PROBE ASSEMBLY

BACKGROUND OF THE INVENTION

1. Field of the Invention

This invention generally relates to an apparatus for counting small articles, and more particularly, to an apparatus for counting small fragments of a fractured tempered glass article and recording or displaying a running tally of the fragments counted.

2. Description of the Prior Art

In the manufacture of tempered glass articles, such as back lights and side lights used in the automotive industry, a tempered light is periodically selected from the production line and fractured to determine whether it is in compliance with a prescribed safety code such as "British Standard 857;1967-Specification for Safety Glass for Land Transport". This code specifies certain ranges for particle or fragmentation count in given size areas of the uniformly tempered fractured glass lights. For example, it sets the number of glass fragments or particles occurring in any two inch by two inch (5 cm×5 cm) square trace marked on a fractured specimen to be not less than 60 for a light of any given thickness. Heretofore, counting of the fragments was done visually and there was considerable opportunity for error as the number of fragments was mentally added by the person doing the counting. Accordingly, it is desirable to both keep a running tally of the number of fragments counted and identify the counted fragments, without relying on the exercise of human judgment.

SUMMARY OF THE INVENTION

Briefly, the apparatus employed to practice the invention generally comprises a novel probe assembly electrically connected to a digital counter; the probe assembly including a switch and a marking device for touching and operating the counter in seriatim. Thus, the fragments touched may be marked and a running tally simultaneously displayed.

OBJECTS AND ADVANTAGES

It is, therefore, an object of this invention to provide an apparatus for counting small fragments by touching them with a probe, thus actuating a counter and accumulating a running tally of the number of fragments touched.

Another object of this invention is to provide for marking of the fragments touched.

Other objects and advantages will become more apparent during the course of the following description, when taken in connection with the accompanying drawings.

BRIEF DESCRIPTION OF THE DRAWINGS

In the drawings, wherein like numerals are employed to designate like parts throughout the same.

DESCRIPTION OF THE PREFERRED EMBODIMENT

Although the counting apparatus constructed in accordance with the invention will be described in conjunction with a fractured, tempered glass window, it will be apparent that it will have general utility in counting other small articles.

Figure 1:
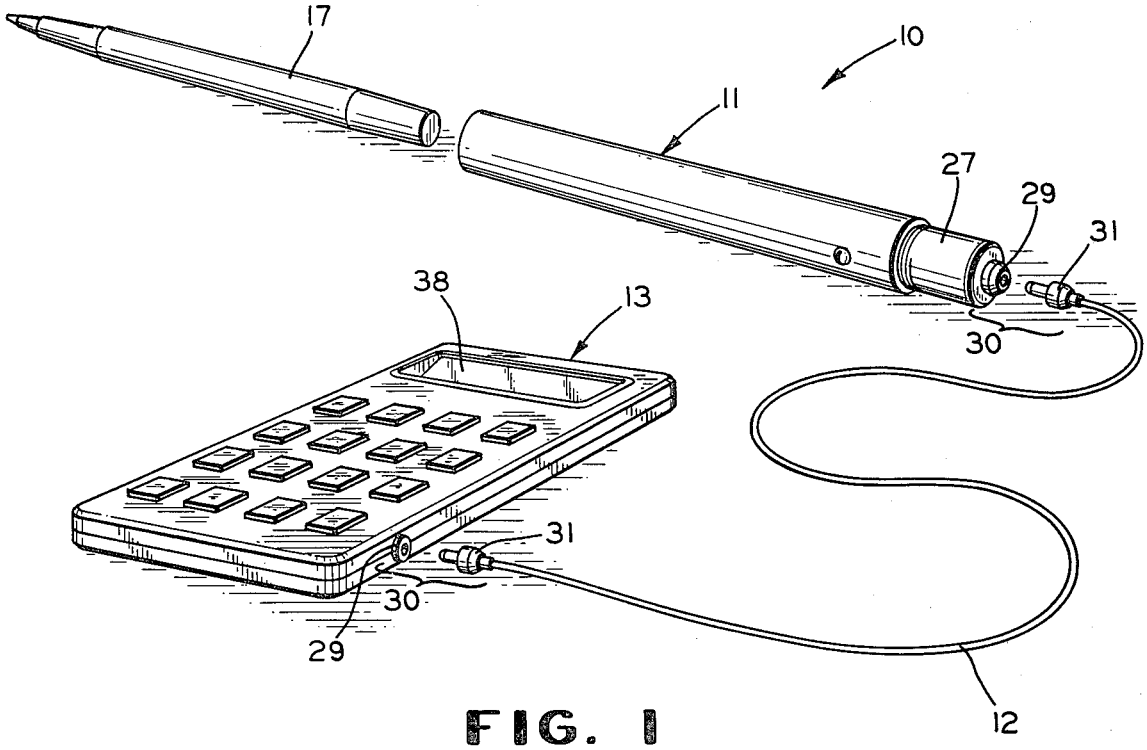
FIG. 1 is an exploded perspective view of the counting apparatus constructed in accordance with the invention.

As illustrated in FIG. 1, the counting apparatus designated in its entirety by the reference numeral 10, generally comprises a probe assembly 11 connected by an electrical conductor 12 to a digital counter 13.

Figure 3:
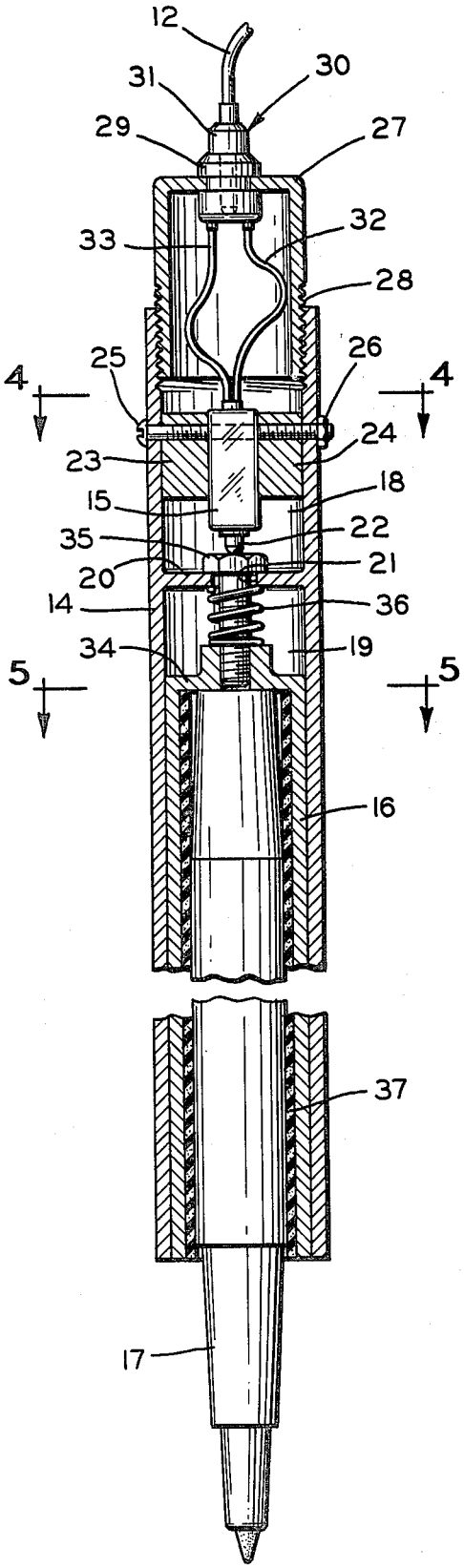
FIG. 3 is an enlarged, longitudinal sectional view along the axis of the probe assembly constructed in accordance with the invention.
Figure 4:
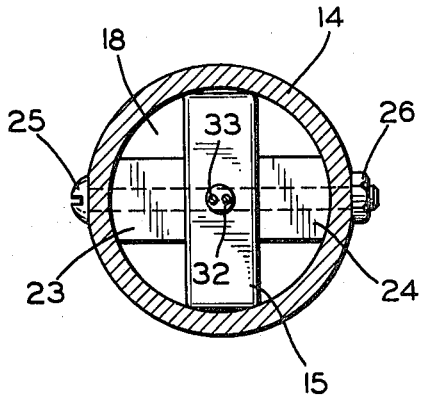
FIG. 4 is an enlarged cross sectional view, taken substantially along line 4—4 of FIG. 3 of the probe assembly.

Referring now to FIG. 3, the probe assembly 11 generally includes an open-ended tubular housing 14, a micro-switch 15 actuated by a piston 16, and a marking stylus 17. More particularly, the tubular housing 14 is an elongated member divided into top and bottom sections 18 and 19, respectively, by an intermediate transverse partition wall 20 provided with a central, axially extending aperture 21. The micro-switch 15 is a commercially available item having an actuating plunger pin 22, and is concentrically disposed within the top section 18 of the housing 14 with the plunger pin 22 extending axially downwardly toward the aperture 21 of the partition wall 20. To this end, the micro-switch 15 is disposed between a pair of spacer blocks 23 and 24 all being secured to the housing 14 by a transverse bolt 25 and a nut 26.

A cup-shaped cap 27 is threadedly attached as at 28, to the upper end of the top section 18 and includes the female portion 29 of an electrical jack 30 also having a male portion 31 which forms one end of the conductor 12. The female portion 29 is connected by a pair of electrical leads 32 and 33 to the micro-switch 15.

Still referring to FIG. 3, the bottom section 19 of the housing 14 contains the piston 16 which is an elongated tubular member having a closed end 34 adjacent the partition wall 20. A cap screw 35 having its headed end contained within the top section 18 of the housing 14, extends through the aperture 21 in the partition wall 20 and is threadedly attached to the closed end 34 of the piston 16. It should be noted that the top surface of the head of the cap screw 35 engages the end of the plunger pin 22 of the micro-switch when the bottom surface thereof engages the partition wall 20 of the housing 14. A compression spring 36 disposed between the partition wall 22 and the closed upper end 34 of the piston 16 and surrounding the shank of the cap screw 35, biases the cap screw to such a position.

Figure 5:
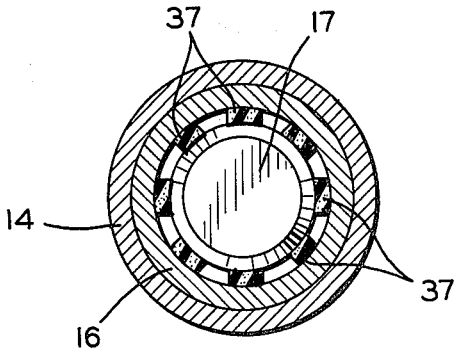
FIG. 5 is an enlarged cross sectional view, taken substantially along line 5—5 of FIG. 3.

The marking stylus 17, which may be of any suitable type, commercially available felt tip marking pen, protrudes from and is removably held within the tubular piston 16 by a plurality of circumferentially spaced strips 37 (see FIG. 5) made of a foam rubber material.

Referring now to FIG. 1, the digital counter 13 may be conveniently constructed by modifying a small commercially available electronic calculator having a constant function and a numerical display panel 38, to record a digit each time the micro-switch 15 of the probe assembly 11 is actuated. To this end, the equals function of the calculator is connected by electrical leads (not shown) to the female portion 29 of another electrical jack 30 also having a male portion 31. The male portion 31 is connected to the other end of the electrical conductor 12.

Figure 2:
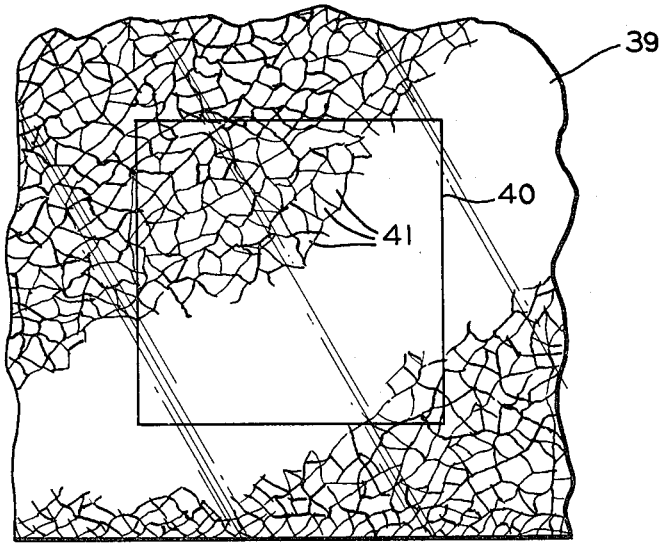
FIG. 2 is a fragmentary view of a fractured tempered glass window illustrating a square trace in which the glass particles are counted.

In use, a tempered glass article such as a window pane 39 is fractured as by a center punch, ball or hammer device (not shown) in the well-known manner, and a specimen area 40 of given size is marked thereon as illustrated in FIG. 2. As is known, when a tempered glass pane is fractured, it disintegrates into a plurality of small, relatively harmless fragments or pieces 41. The so-called "fragment count" or "particle count" denotes the number of pieces formed in a given area of the fractured glass, and is indicative of the degree of tempering.

With the calculator turned on, an operator touches each fragment 41 within the given area with the stylus 17 of the probe assembly 11 with sufficient pressure to depress the plunger pin 22 of the micro-switch 15, thereby actuating the calculator each time a fragment is touched. The fragments are thus cumulatively added by the calculator, with a running tally being displayed on the panel 38 thereof. In addition, each fragment 41 is marked by the stylus 17 so that the operator is able to observe which fragments have been previously counted.

It is to be understood that the form of the invention herewith shown and described is to be taken as an illustrative embodiment only of the same, and that various changes in the shape, size and arrangement of the parts may be resorted to without departing from the spirit of the invention.

We claim:

1. A probe assembly for initiating electrical signals in seriatim for use in a counting apparatus comprising:

a. an elongated tubular housing having a transverse wall separating it into top and bottom sections, said sections being axially aligned;

b. a switch disposed in said top section for initiating electrical signals and including an axially extending plunger pin;

c. means disposed in said bottom section for operating said switch, said operating means including an axially reciprocal piston coaxially aligned with said plunger pin and engageable therewith for movement as a unit, said piston including an axial bore; and d. a marking stylus detachably mounted within said bore to move with said piston, said stylus extending beyond the end of said elongated housing.

2. A probe assembly for initiating electrical signals in seriatim as claimed in claim 1, in combination with a counter for registering the number of electrical signals initiated by said switch and including means for connecting said switch to said counter, said counter comprising an electronic calculator including means for displaying the number of produced signals in cumulative numerical form.

3. A probe assembly for initiating electrical signals in seriatim as claimed in claim 1, including means for biasing said reciprocal piston into an extended position.

4. A probe assembly for initiating electrical signals in seriatim as claimed in claim 3, wherein said biasing means comprises a compression spring disposed between the wall of said elongated housing and an end of said reciprocal piston.

5. A probe assembly for initiating electrical signals in seriatim as claimed in claim 1, wherein said reciprocal piston includes means for engaging said plunger pin and limiting axial movement of said reciprocal piston into the extended position.

6. A probe assembly for initiating electrical signals in seriatim as claimed in claim 5, wherein said engaging means comprises a cap screw threadedly received in the upper end of said reciprocal piston.

7. A probe assembly for initiating electrical signals in seriatim as claimed in claim 6, wherein the head of said cap screw is disposed in said upper section of said elongated housing and having its shank extending axially through an aperture provided in the wall separating said section and said compression spring surrounds the shank of said cap screw.

8. A probe assembly for initiating electrical signals in seriatim as claimed in claim 1, wherein said signal producing means is an electrical micro-switch.

9. A probe assembly for initiating electrical signals in seriatim as claimed in claim 8, including a cap threadedly connected to the top portion of said elongated housing, an electrical jack mounted on said cap and an electrical conductor connecting said micro-switch to said jack.

10. A probe assembly for initiating electrical signals in seriatim as claimed in claim 1, wherein said marking stylus is a felt tip pen.

11. A probe assembly for initiating electrical signals in seriatim as claimed in claim 1, including means detachably mounting said marking stylus within said bore comprising a plurality of resilient, axially extending strips circumferentially spaced around the bore of said reciprocal piston.

* * * * *